US005138954A

United States Patent [19]

Mulcahy

[11] Patent Number: 5,138,954

[45] Date of Patent: Aug. 18, 1992

[54] FREIGHT RAILCAR TRUCK AND BOLSTER FOR OUTBOARD SUPPORT OF CAR BODY WITH SIDE BEARINGS LOCATED ENTIRELY OUTISDE OF THE SIDEFRAMES FOR RECEIVING THE ENTIRE VEHICLE WEIGHT

[75] Inventor: Harry W. Mulcahy, Griffith, Ind.

[73] Assignee: AMSTED Industries Inc., Chicago, Ill.

[21] Appl. No.: 833,158

[22] Filed: Feb. 10, 1992

Related U.S. Application Data

[63] Continuation of Ser. No. 582,421, Sep. 14, 1990, abandoned.

[51] Int. Cl.[5] ..... B61F 5/14

[52] U.S. Cl. ..... 105/199.3

[58] Field of Search ..... 105/197.05, 199.1, 199.2, 105/199.3, 200, 226, 418, 453

[56] References Cited

U.S. PATENT DOCUMENTS

| | | | |
|---|---|---|---|
| 293,608 | 2/1884 | Wilson | 105/199.1 |
| 424,282 | 3/1890 | Elliot | 105/199.1 |
| 516,935 | 3/1894 | King | 105/197.1 |
| 621,826 | 3/1899 | Kling | 105/197.05 |
| 625,745 | 5/1899 | Cliff | 105/199.3 X |
| 731,626 | 6/1903 | Sheffield et al. | 105/199.1 |
| 900,760 | 10/1908 | mcAdam | 105/201 |
| 1,029,582 | 6/1912 | Beasley | 105/197.05 |
| 1,097,488 | 5/1914 | Van Kirk | 105/200 |
| 1,211,789 | 1/1917 | Thompson | 105/201 |
| 4,1237,791 | 12/1989 | Jackson et al. | 105/199.1 X |
| 1,408,321 | 2/1922 | Wellman | 105/197.05 X |
| 2,011,918 | 8/1935 | Stedefeld et al. | 105/199.1 X |
| 2,046,391 | 7/1936 | Latshaw | 105/199.1 X |
| 2,419,188 | 4/1947 | Milleville | 105/200 |
| 2,530,495 | 11/1950 | Waldrogel | 105/199.1 X |
| 3,350,146 | 10/1967 | Williams | 105/199.3 |
| 3,961,584 | 6/1976 | Paton et al. | 105/199.1 X |
| 4,108,080 | 8/1976 | Crane et al. | 105/197.05 X |
| 4,676,172 | 6/1987 | Bullock | 105/168 |
| 5,109,776 | 5/1992 | Johnstone et al. | 105/199.3 |

FOREIGN PATENT DOCUMENTS

| | | | |
|---|---|---|---|
| 403831 | 6/1966 | Switzerland | 105/199.1 |

*Primary Examiner*—Robert J. Oberleitner
*Assistant Examiner*—S. Joseph Morano
*Attorney, Agent, or Firm*—Edward J. Brosius; F. S. Gregorczyk

[57] ABSTRACT

A three piece freight railcar truck with a truck bolster having distal ends that extend outward of the truck side frames to beneath the sides of a rail car body and the bolster ends have seats for self leveling bearings which directly support the car body at the side sills.

18 Claims, 5 Drawing Sheets

FREIGHT RAILCAR TRUCK AND BOLSTER FOR OUTBOARD SUPPORT OF CAR BODY WITH SIDE BEARINGS LOCATED ENTIRELY OUTISDE OF THE SIDEFRAMES FOR RECEIVING THE ENTIRE VEHICLE WEIGHT

This is a continuation of application Ser. No. 582,421 filed on Sep. 14, 1990 now abandoned.

BACKGROUND OF THE INVENTION

This invention relates to an improved freight railcar truck and more particularly is directed to an improved truck bolster having distal ends that extend outward of the truck side frames to support the weight of a carbody at its side sills.

Although there are other designs for freight railcar trucks, the vast preponderance of freight car trucks in domestic U.S. service are known as three piece outboard bearing trucks. That is to say the truck comprises three principal parts, namely a floating truck bolster laterally connecting two side frames; and the side frames are mounted on two wheelsets each including two flanged wheels mounted on an axle. The truck bolster is spring supported on what is commonly referred to as a "secondary suspension" system for vertical cushioning movement on the side frames. Bearings are mounted on the axles adjacent each wheel and the ends of each side frame are primarily suspended between corresponding bearings on the two axles. In freight car truck construction there is no significant vertical spring movement of the primary suspension. Where the bearings and side frames are located outboard of the wheels, the truck is referred to as outboard bearing.

In most rail car assemblies two trucks are required, one at each car end, and the car under frame includes longitudinal side sills and transverse body bolsters, the latter being located directly above the truck bolsters and serving to transfer the car load to center bearing plates (or bowls) at the geometric center of the truck bolsters. There is usually also a center sill at the ends of the rail car intersecting the body bolsters which center sills contain coupling gear and serve to transmit longitudinal draft and buff forces to the car body bolster and thence to the truck bolster.

Examples of other rail car truck designs may be found in the following United States patents:

I. Rail car trucks connecting the car body directly to the truck side frame:

- Ser. No. 516,935 springs extend directly above the side frames to support the car body without a truck bolster;
- Ser. No. 900,760 springs extend directly upwardly from each side frame to the car body and a truck crosspiece is rigidly fastened to both side frames;
- U.S. Pat. No. 2,011,918 springs support each side frame on axles outboard of the wheels with rigid cross beams between the side frames, and the car body sits on rollers carried by the side frames; and
- U.S. Pat. No. 3,961,584 springs supporting the car body extend upward from side frames that are bolted to a horizontal cross plate.

II. Rail car trucks supporting the car body upon bolster ends outboard of the side frames:

- Ser. No. 731,626 a passenger car body is supported on springs carried on a second transverse beam outboard of side frames that are otherwise connected by a truck bolster (a second embodiment for freight cars supports the car body on springs seated on a truck bolster inboard of the wheels);
- U.S. Pat. No. 1,211,789 levers pivotally mounted on side frames support the car body on structures inward of the side sills;
- U.S. Pat. No. 4,237,791 an inboard bearing truck has a bolster that carries car supporting pneumatic springs outboard of the wheels.

III. Other:

- U.S. Pat. No. 2,046,391 an inboard bearing truck supports the car body on a bolster centerplate and has auxiliary roller type side bearings on ends of the bolster outboard of the wheels.

From the foregoing prior art and other knowledge of the railroad industry it can be ascertained that freight car construction, as contrasted to passenger car construction, favors a minimum of truck parts and simplified suspension systems so as to reliably carry heavy loads at minimum operating expense and low original equipment cost. Simplicity of design with minimum weight and number of parts will usually contribute toward those goals. Additionally the industry seeks rail car dynamic stability for operating safety; and efforts to lower a car center of gravity and to reduce car roll will contribute toward that goal.

SUMMARY OF THE INVENTION

Therefore, it is an object of the present invention to devise a rail car truck that will resist the tendency of a rail car body to roll from side to side.

It is another object of the present invention to devise a rail car truck that will enable weight reduction in the car body structure.

It is still another object of the present invention to devise a freight rail car truck to support a car body at the side sills on the secondary suspension system of a floating bolster.

It is yet another object of the present invention to provide an outboard bearing freight car truck and truck bolster for carrying a car body at the side sills thereof.

Accordingly, the present invention involves a unique truck bolster for a three piece freight rail car truck wherein the ends of a floating bolster extend outwardly beyond the side frames to beneath the car sides to directly carry a car body at the body side sills and thereby permit elimination of the heavy center bearing and redesign of the car body bolster with consequent weight savings.

BRIEF DESCRIPTION OF THE DRAWINGS

Further objects and advantages will become apparent upon reading the following detailed description of an embodiment of the invention in conjunction with the drawings wherein.

DETAILED DESCRIPTION OF THE INVENTION

Figure 1:
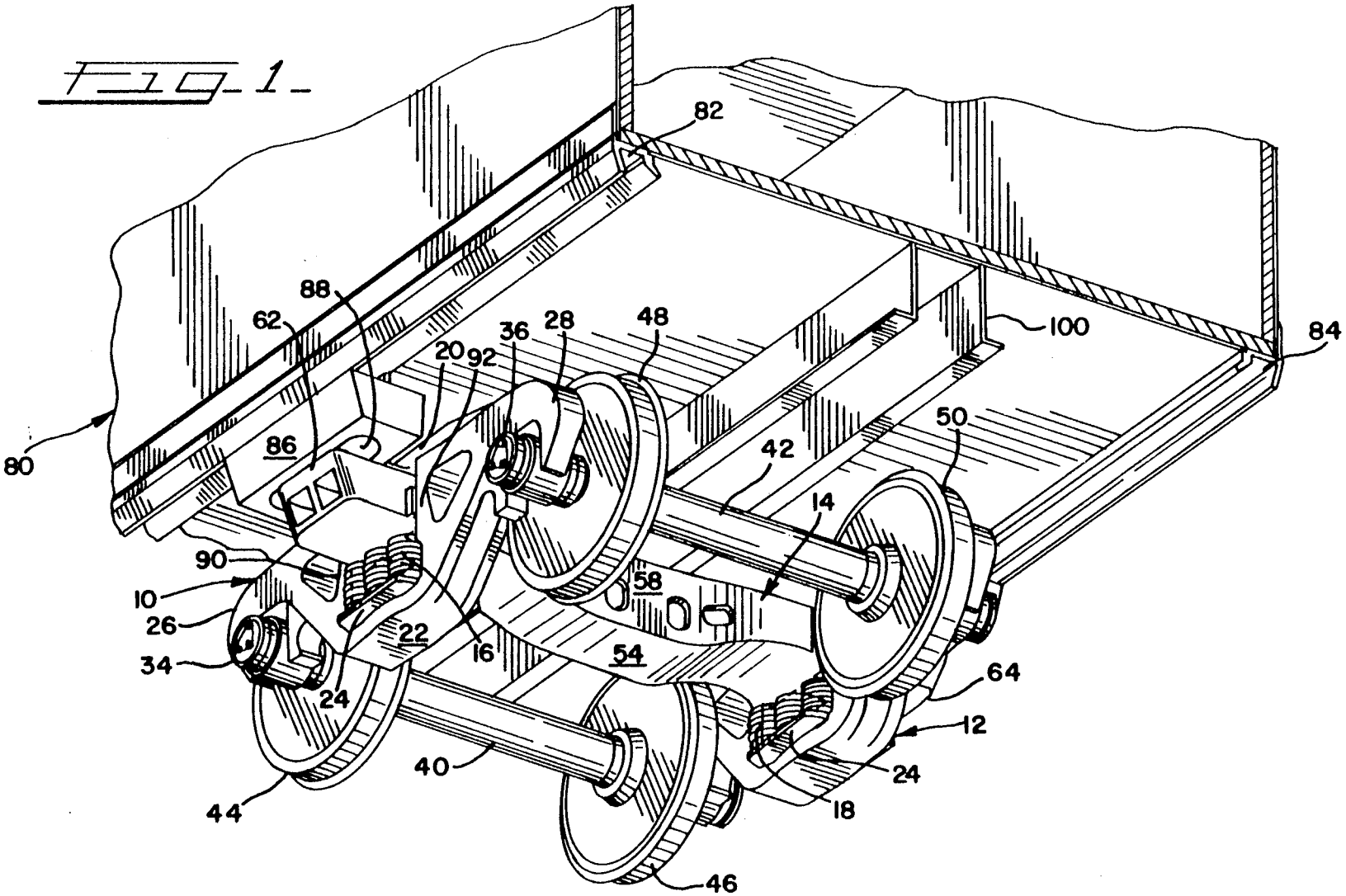
FIG. 1 is a perspective view from beneath a car body (partially shown) and car truck incorporating the present invention.
Figure 2:
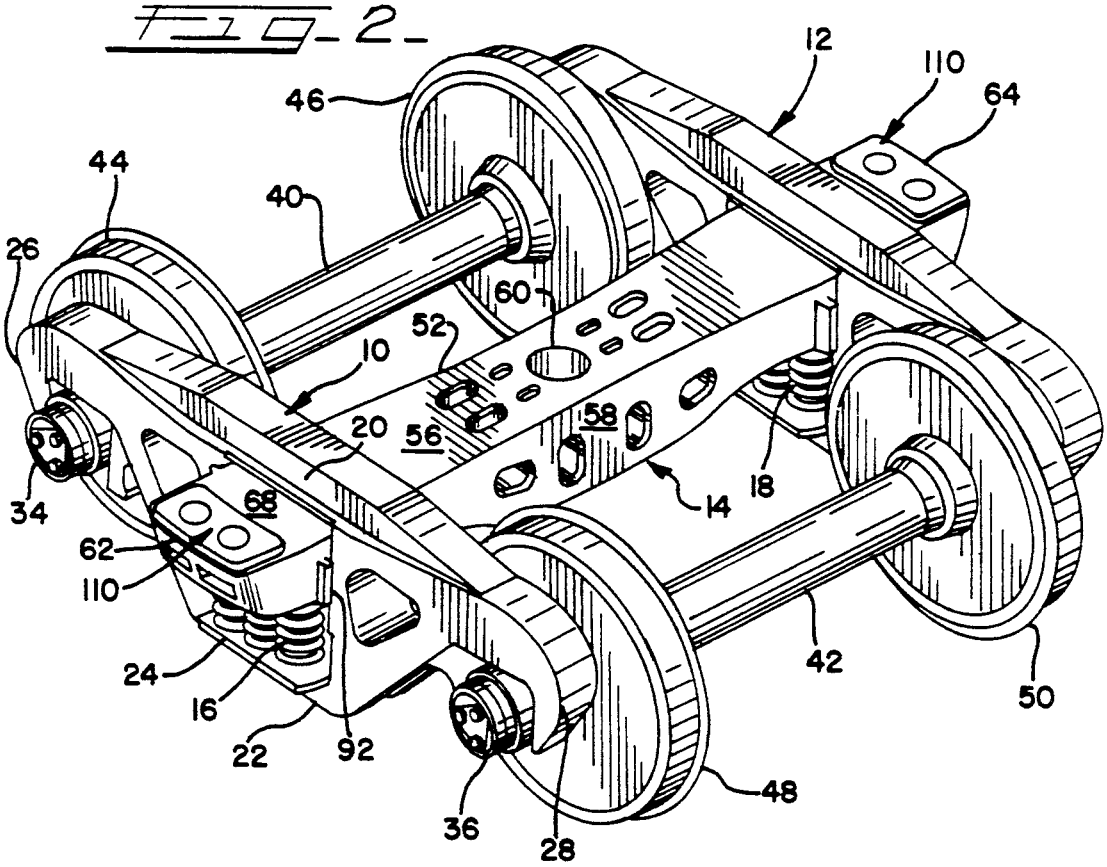
FIG. 2 is a perspective view from above the car truck of FIG. 1 with car body removed.

As shown in FIGS. 1 and 2 a preferred embodiment of the present invention is directed to a three piece outboard bearing rail car truck comprising two side frames generally 10, 12 and a unique transverse bolster generally 14 that extends substantially the full width of a railcar and is supported on a secondary suspension system comprising coil springs 16, 18 mounted on the side frames 10, 12 respectively. Each of the side frames, usually of cast steel, includes an upper compression member 20, a lower tension member 22 having a spring seat 24 and two pedestal jaws 26, 28. The latter are supported upon journal bearings 34, 36 fitted upon a pair of axles 40, 42 outboard of wheel sets 44, 46 and 48, 50, respectively.

According to the present invention the bolster 14, preferably also of cast steel, has a box-like body 52 with top wall 56, bottom wall 54 and interconnecting side walls 58. A pin receptor 60 is centrally located in top wall 56 and two distal ends 62, 64 extend outwardly of the body 52 at a distance from receptor 60 beyond the side frames 10, 12. Each distal end 62, 64 includes flat, horizontal, surfaces 68 adapted to directly carry a rail car body generally 80 at or adjacent the side sills 82, 84 thereof. Preferably the bolster also includes an interior web 66 parallel to and central of the side walls 58.

Figure 3:
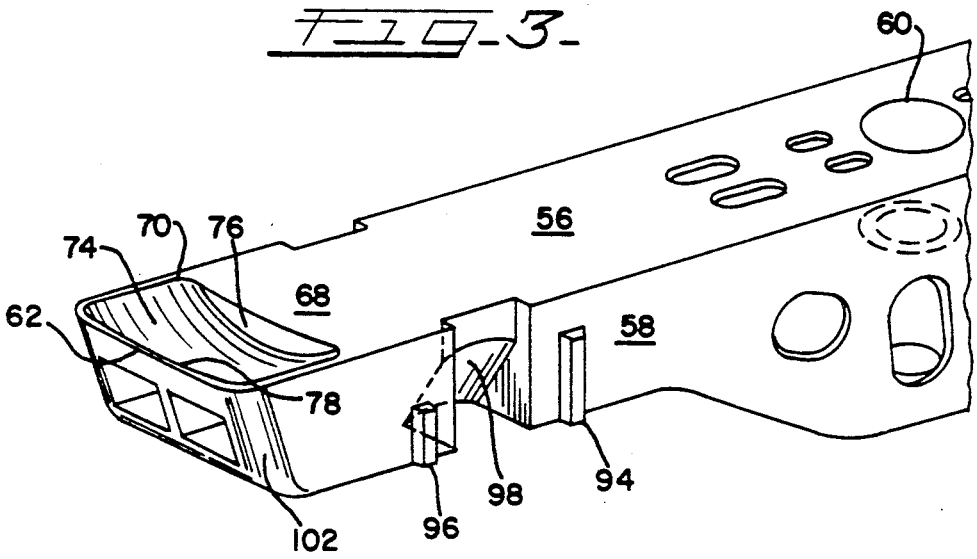
FIG. 3 is a partial (half) detail view of a truck bolster according to the present invention.
Figure 4:
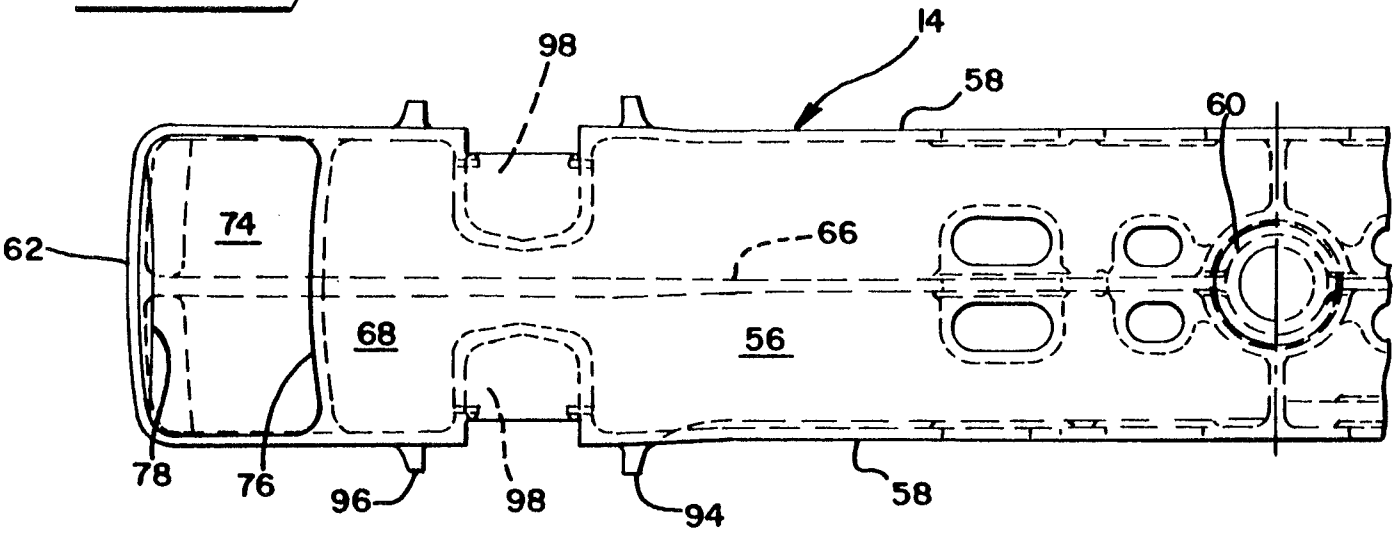
FIG. 4 is a plan view of the bolster (half) of FIG. 3.
Figure 5:
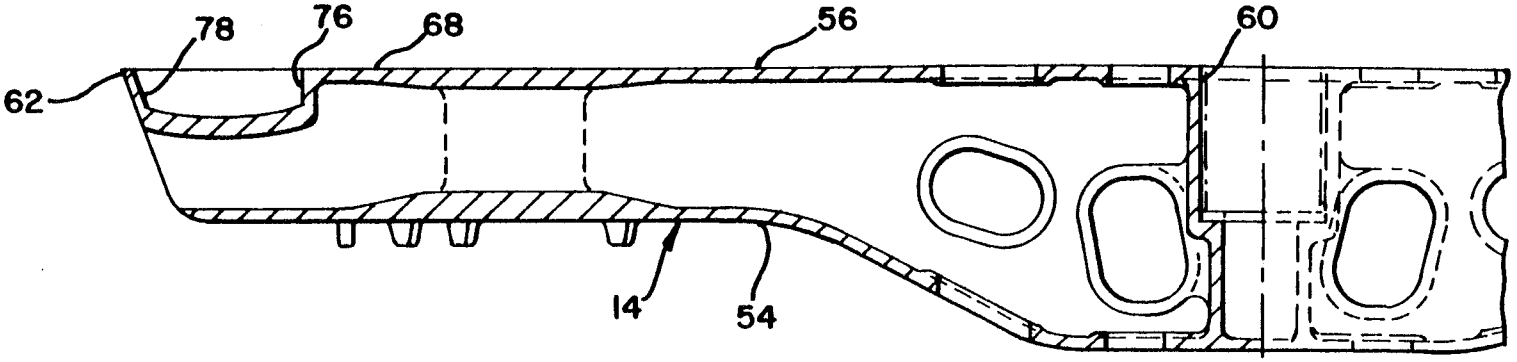
FIG. 5 is a sectional elevation view of the bolster (half) of FIG. 4.

As shown in FIGS. 3–5, the surfaces 68 of distal ends 62, 64 are provided with seats 70 to receive friction side bearings generally 110 (more fully described hereinafter) to permit controlled sliding movement between the bolster ends 62, 64 and the railcar body 80. Preferably the seats 70 have concave spherical segment surfaces 74, so as to receive convex concentric undersurfaces on bearings 110, which permit the bearings to tilt in all directions and thereby enable the bearings 110 to be self-adjusting to the railcar body 80. It will also be seen in FIGS. 3–5 that the ends of bolster 14 incline inwardly from top to bottom (so as to keep within the American Association of Railroads standard clearance line at track side) and accordingly it is advantageous to locate the low point of seat spherical surface 74 slightly offset inwardly (toward the receptacle 60) from the center of the concave seat 70. Additionally, it will be noted that the spherical surface 74 extends smoothly to the horizontal surface 68 in a direction transverse of the bolster 14 but in the direction of the bolster axis is truncated by shallow transverse arcuate walls, namely an inner cylindrical wall 76 and an outer conical wall 78 both such arcuate walls having radii from the center of pin receptor 60.

As illustrated in FIG. 1, it is convenient to locate an outrigger member 86 between each car side sill 82, 84 and the corresponding bolster distal ends 62, 64. In the preferred embodiment, the outriggers 86 are permanently secured to the car body 80 at the side sills 82, 84 and the underside of each outrigger 86 may have a wear pad 88 that slidingly rests on the respective side bearing 110 at each bolster end.

The car load is thus supported on the distal ends 62, 64 of bolster 14 and transmitted to the side frames 10, 12 through springs 16, 18. In accordance with prior three piece trucks the bolster 14 is movable vertically within each side frame between vertical columns 90, 92 and is provided with inner and outer column positioning gibs 94, 96 and friction shoe pockets 98. Since the present bolster 14 supports the car load at its ends 62, 64, the vertical dimension of the bolster at the pockets 98 is slightly greater than prior bolsters to withstand higher bending moments and the side frames 10, 12 and vertical columns 90, 92 are slightly higher to accommodate the greater vertical dimension of the bolster ends.

It will be understood that the present invention provides for supporting the weight of a car body 80 at the side sills 82, 84 rather than upon a center sill 100 which heretofore has been the standard practice for freight car construction. In this way the car under frame structure may be simplified and lightened and the need for a traditional transverse body bolster above each truck bolster may be eliminated. The truck bolster 14 thus does not require a center bearing bowl to support the car body, however, a central vertical connection such as a column or pin (not shown) is located between the receptor 60 on bolster 14 and the car center sill 100 so as to establish a center of rotation between truck and car body and to transmit horizontal forces between truck and car body.

Since the bolster 14 will turn beneath the car body 80, it is preferred to relieve the bolster distal end corners 102 so that no part of the bolster 14 will extend beyond the car side sills 82, 84 or the American Association of Railroads (AAR) standard clearance line at track side during curving.

In one embodiment for light weight car bodies each friction side bearing 110 received in seats 70 at the ends 62, 64 of bolster 14 is provided with a multi-friction means that functions to provide sufficient frictional engagement with pads 88 to control truck hunting (transverse oscillations) even under no load (empty rail car) or low load conditions, yet also allow for relative turning (truck curving) movement under a fully loaded condition. This is accomplished with a bearing member generally 110, shown in FIGS. 6–8, having a major friction body 112 comprised of a relatively low friction material such as teflon coated machined steel that has a first relatively low friction coefficient $F_1$ of about 0.05–0.07, which surrounds one or more secondary friction bodies 114 of relatively higher friction material such as cast steel that has a second friction coefficient $F_2$ of about 0.35. Each secondary friction body 114 is received in a cavity 116 in the major friction body 112 and is biased outwardly by a spring 118. Both major and secondary friction bodies 112, 114 have flat upper friction surfaces or faces 120, 122 that bear against the pads 88 on car body outrigger 86. It will be understood that the frictional resistance to sliding motion between each bearing member 110 and corresponding pad 88 of a loaded car will have two components. One component R-1 will be the product of the car weight (including load), the area of friction face 120 of the major friction body 112 and the first coefficient of friction $F_1$. The second component R-2 will be an essentially constant product of the force of spring 118, the total area of secondary friction faces 122 of the secondary friction bodies 114 and the second coefficient of friction $F_2$. The second component is, by selected design parameters, made sufficient to control the tendency of a given truck configuration to hunt at expected empty car operating speeds.

Figure 9:
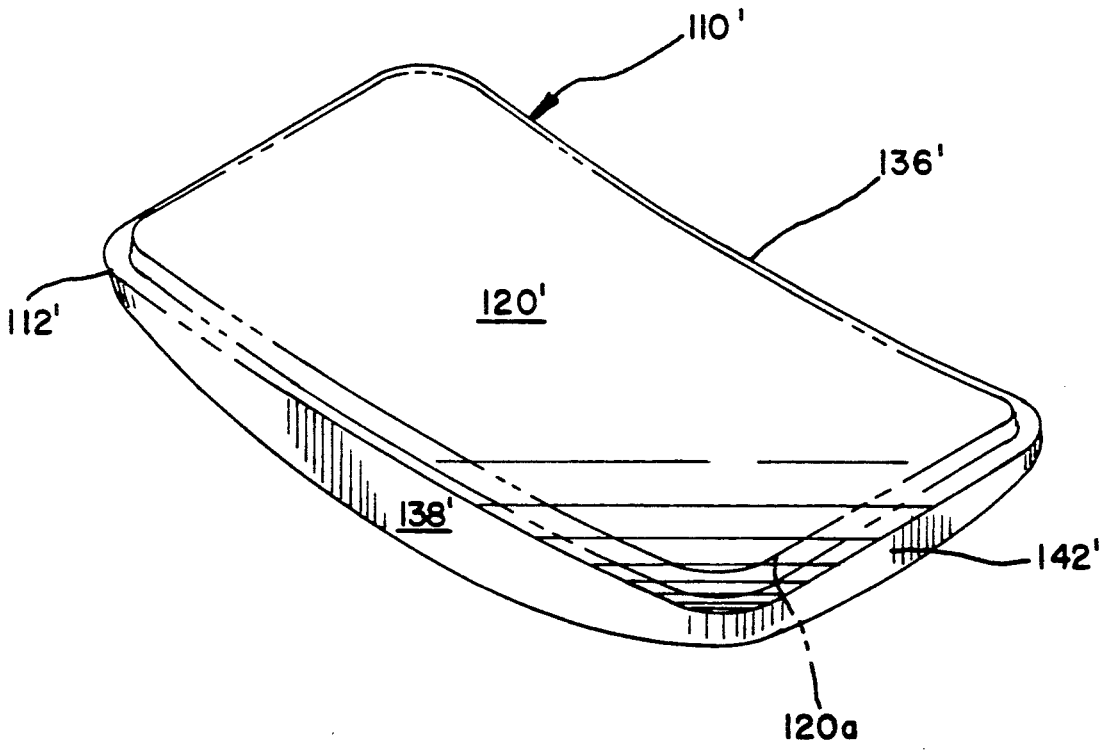
FIG. 9 is a perspective view of another embodiment of a bolster bearing suitable for use in the present invention.

In another embodiment for heavy weight car bodies and general application, a bearing member generally 110', shown in FIG. 9, having a single friction means is received in each seat 70. The bearing member 110' comprises a solid body 112' having uniform friction face 120' either coated with a low friction material or supporting a pad 120*a'* of a low friction material such as an ultra high molecular weight polymer or the like.

Both bearing member embodiments generally 110 and 110' are preferably in the form of a slightly arcuate body 112, 112' or shoe that is substantially congruent with the concave seat 70 and have a convex and preferably spherical undersurface 124 that is slightly smaller and received in the concave seat 70 on the surface 68 of each distal end 66, 64 of bolster 14. In this way each bearing member 110 will be free to tilt transversely and longitudinally of the car so as to be self leveling against its respective pad 88 under the weight of the car body 80.

It will be seen in FIGS. 6–9 that for each embodiment of the bearing members the body includes concentric arcuate end walls 136, 138 and straight side walls 140, 142 extending between the spherical undersurface 124 and the friction face 120. The arcuate end walls 136, 138 are formed to be concentric with the respective inner cylindrical wall 76 and outer conical wall 78 of a bearing seat 70 and the bearing body 112 is sized to fit therein. Accordingly, for a bolster of 9 foot $11\frac{7}{8}$ inch maximum dimension, the bolster distal ends 62, 64 are 16.88 inches wide and terminate in outer arcs having radii of 59.94 inches. The outer end and side walls of each bearing seat are approximately $\frac{1}{2}$ inch thick and the inner cylindrical wall is formed on a radius of 50.56 inch (all radii measured from the center of the bolster pin receptor 60). It is desirable that each bearing member 110, 110' be sized to leave a peripheral gap of about 0.44 inch between its peripheral walls 136, 138, 140 and 142 and the perimeter of the bearing seat 70. Accordingly, the bearing bodies 112, 112' are cast to be approximately 15 inches between side walls 140, 142 and 8 inches between arcuate walls 136, 138 with inner wall 136 formed on a radius of 51 inches and the outer conical wall 138 formed from a top radius of 59 inches. The convex spherical undersurface 124 of each bearing member and the concave shperical surface 74 of bearing seat 70 are typically formed on radii of 15 inches.

Figure 6:
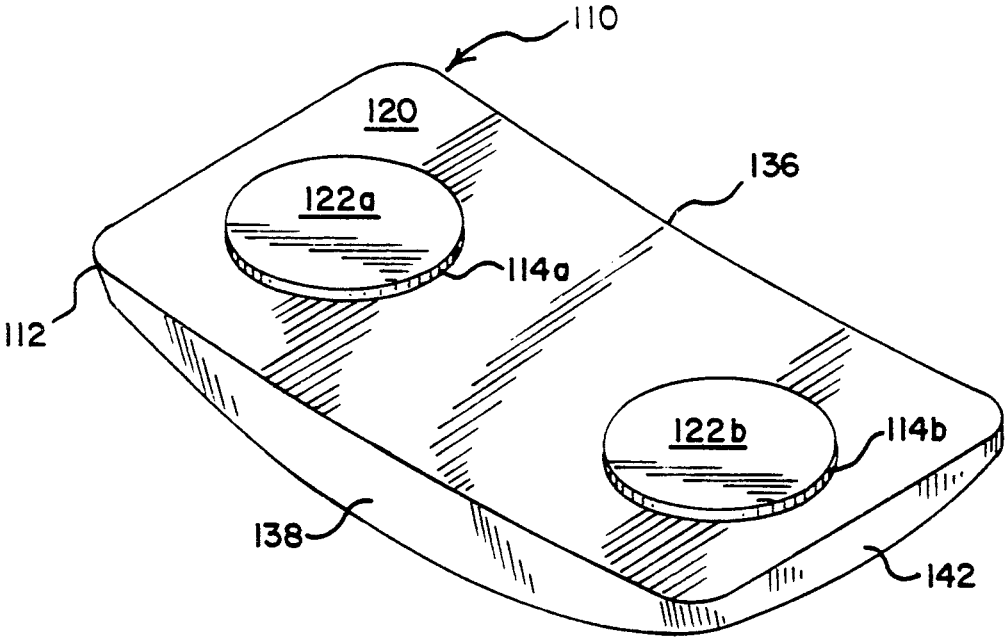
FIG. 6 is a perspective view of one bolster bearing embodiment of the present invention.
Figure 7:
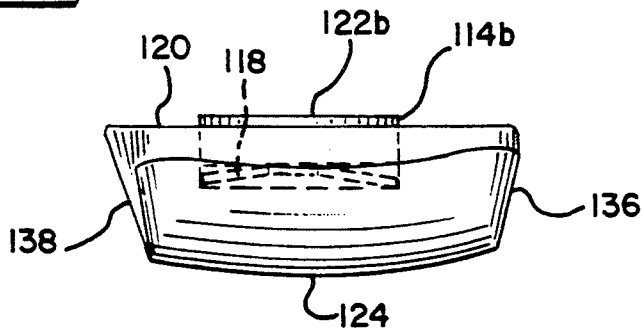
FIG. 7 is a side elevation of the bolster bearing of FIG. 6.
Figure 8:
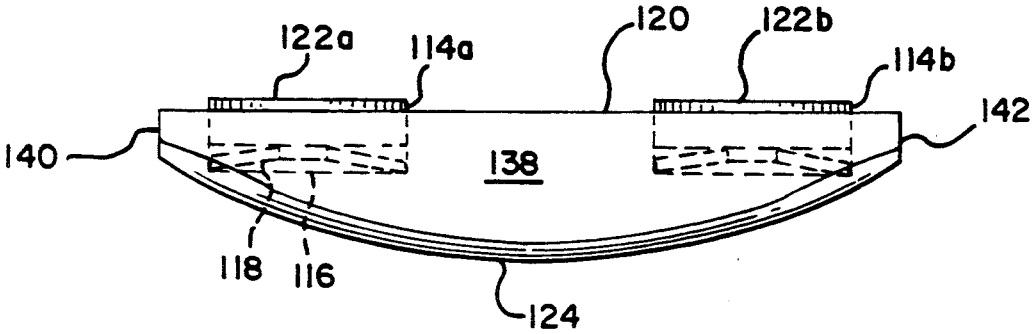
FIG. 8 is an end elevation of the bolster bearing of FIG. 6.

For the one embodiment bearings 110 of FIGS. 6–8 the second friction bodies 114*a* and 114*b* may typically comprise discs of 4 inch diameter.

Variations and modifications may be made without departing from the spirit and scope of the invention which is defined in the following claims.

What is claimed is:

1. An improved rail car truck bolster comprising:

a box like body having upper and lower walls and sidewalls therebetween;

a pin receptor centrally located in said upper wall;

gibs on said sidewalls spaced from said pin receptor, said gibs adapted to position said truck bolster in respective sideframes of a truck;

distal ends on said bolster extending beyond said gibs such that the entire weight of a railcar is supported entirely outside said side frames at about the side sills thereof.

2. The truck bolster of claim 1 including bearing seats entirely outside said side frames adjacent the distal ends.

3. The truck bolster of claim 2 wherein said bearing seats are recessed into the upper wall of the bolster and have arcuate surfaces to facilitate leveling of bearings placed therein.

4. The truck bolster of claim 3 wherein said recessed bearing seats include concentric arcuate inner and outer end walls on radii measured from said pin receptor.

5. The truck bolster of claim 4 wherein said outer end wall is conical.

6. The truck bolster of claim 3 wherein said arcuate surfaces are spherical segments.

7. The truck bolster of claim 1 including bearing means on each of said distal ends.

8. The truck bolster of claim 1 including a sliding bearing means on each of said distal ends.

9. The truck bolster of claim 1 including recessed concave bearing seats on each of said distal ends at locations to position bearing means therein beneath said side sills.

10. The truck bolster of claim 9 wherein said bearing seats include spherical surface segments to facilitate leveling of congruent bearings placed therein.

11. The truck bolster of claim 10 wherein said bearing means includes convex undersurfaces and substantially planar upper surfaces for constantly bearing against and fully supporting a rail car body.

12. An improved rail car truck comprising a floating transverse structural truck bolster carried on springs in side frames, said bolster housing side bearings, the improvement comprising:

structural truck bolster distal ends extending outwardly of said side frames proximate to the car body side sills for constantly carrying the entire weight of a car body on the side bearing, said side bearing located entirely outside said side frames such that the entire weight of said car is transferred from side sills directly into said side bearings, then onto said truck bolster distal ends, and then onto said springs in said side frames.

13. The rail car truck of claim 12 including recessed concave seats on each of said distal ends at locations to position said side bearings therein beneath the side sills of a car body.

14. The rail car truck of claim 13 wherein said concave seats include concentric arcuate inner and outer end walls on radii measured from the vertical center of said truck bolster.

15. The rail car of claim 14 wherein said outer end wall is conical.

16. The rail car truck of claim 13 wherein said concave seats are spherical.

17. The rail car truck of claim 16 wherein said side bearings have substantially planar surfaces for constantly carrying the rail car body below the side sills thereof and having a spherical undersurface opposite said planar surfaces, said undersurface being congruent with said seats.

18. The rail car truck of claim 12, in combination with a railcar body and an outrigger positioned between each said distal end and one of said side sills of said car body.

* * * * *